US011825962B2

(12) United States Patent
Deshpande et al.

(10) Patent No.: US 11,825,962 B2
(45) Date of Patent: Nov. 28, 2023

(54) BEVERAGE COOLER FOR PROVIDING SUPERCOOLED OR CHILLED BEVERAGES

(71) Applicant: PepsiCo, Inc., Purchase, NY (US)

(72) Inventors: Prashant Deshpande, Gurgaon (IN); Gurmeet Singh Bhutani, Gurgaon (IN)

(73) Assignee: PepsiCo, Inc., Purchase, NY (US)

( * ) Notice: Subject to any disclaimer, the term of this patent is extended or adjusted under 35 U.S.C. 154(b) by 215 days.

(21) Appl. No.: 17/172,728

(22) Filed: Feb. 10, 2021

(65) Prior Publication Data

US 2021/0244199 A1 Aug. 12, 2021

(30) Foreign Application Priority Data

Feb. 11, 2020 (IN) ..... 202041005811

(51) Int. Cl.
*A47F 3/04* (2006.01)
*A47F 3/00* (2006.01)

(52) U.S. Cl.
CPC ..... *A47F 3/0434* (2013.01); *A47F 3/002* (2013.01)

(58) Field of Classification Search
CPC ..... F25D 2700/02; F25D 2700/10; F25D 2700/12; F25D 2700/123; F25D 27/005; A47F 3/002; A47F 3/0434
See application file for complete search history.

(56) References Cited

U.S. PATENT DOCUMENTS 6,158,227 A 12/2000 Seeley
7,728,711 B2 * 6/2010 Shoenfeld ..... E05B 47/0012 340/5.1
8,464,544 B2 6/2013 Shin et al.
10,495,377 B2 * 12/2019 Linney, II ..... F25D 23/028
10,501,972 B2 * 12/2019 Twiggar, III ..... E05D 7/00
10,775,097 B2 * 9/2020 Denison ..... E05B 65/0811
10,808,990 B2 * 10/2020 Koo ..... A47F 3/0434
11,493,262 B2 * 11/2022 Denison ..... E05B 65/0811
2008/0066506 A1 3/2008 Carbajal et al.
2009/0236954 A1 9/2009 Kobayashi et al.
(Continued)

OTHER PUBLICATIONS

International Search Report and Written Opinion in International Application No. PCT/US2021/017435, dated Apr. 27, 2021 (11 pages).

*Primary Examiner* — Patrick D Hawn
(74) *Attorney, Agent, or Firm* — Sterne, Kessler, Goldstein & Fox P.L.L.C.

(57) ABSTRACT

A cooler includes a cabinet having an interior volume for storing a beverage container containing a beverage and a door for providing access to the interior volume of the cabinet. The cooler further includes a lock configured to maintain door in a closed position when the lock is engaged. The cooler includes a cooling unit configured to maintain the cabinet at a predetermined temperature and a temperature sensor arranged within the cabinet that detects a temperature within the cabinet. A control unit is in communication with the cooling unit and the temperature sensor, and the control unit is configured to control the cooling unit to maintain a temperature within the cabinet at a predetermined temperature as determined by the temperature sensor. The control unit may be configured to lock the door until a temperature within the cabinet is at the predetermined temperature.

11 Claims, 11 Drawing Sheets

(56) References Cited

U.S. PATENT DOCUMENTS

| | | | | |
|---|---|---|---|---|
| 2010/0287963 | A1* | 11/2010 | Billen | F25D 29/00 62/126 |
| 2011/0239675 | A1 | 10/2011 | Roekens | |
| 2015/0322694 | A1 | 11/2015 | Carr et al. | |
| 2016/0290713 | A1* | 10/2016 | Twiggar, III | E05D 7/00 |
| 2017/0254584 | A1* | 9/2017 | Denison | E05B 47/0603 |
| 2018/0164033 | A1 | 6/2018 | Lee | |
| 2019/0042015 | A1 | 2/2019 | Lee et al. | |
| 2020/0315373 | A1* | 10/2020 | Deshpande | G07F 11/34 |

* cited by examiner

BEVERAGE COOLER FOR PROVIDING SUPERCOOLED OR CHILLED BEVERAGES

FIELD

Embodiments described herein generally relate to coolers for beverage containers and other products. Specifically, embodiments described herein relate to coolers having an adjustable temperature so as to be capable of providing either chilled beverages or supercooled beverages.

BACKGROUND

Packaged beverages, such as bottled or canned beverages, are often chilled or cooled to provide a cold, refreshing beverage. However, consumers may desire a slush beverage that is part liquid and part solid to provide a unique texture and drinking experience. Further, slush beverages may remain cold longer than a chilled drink, and as the slush beverage melts, the beverage is not diluted.

In order to form a slush beverage within a beverage container, the beverage container must be stored at a temperature at or below a freezing point of the beverage. The beverage is cooled below its freezing point but remains in a liquid state, and is a "supercooled" liquid. The beverage remains in a liquid state until agitated, such as by shaking the beverage container, striking, hitting or dropping the beverage container, or by uncapping the beverage container to release carbonation, among other methods. Once agitated, the beverage undergoes nucleation and begins to turn into a partial solid or slush beverage.

If the beverage container is not stored at a low enough temperature, e.g., a temperature at or below the freezing point of the beverage, the beverage will not undergo nucleation. However, if the temperature of the beverage is too low, the beverage may freeze within the cooler. Thus, a cooler is required that maintains a precise temperature for supercooling beverages.

SUMMARY OF THE INVENTION

Some embodiments described herein relate to a cooler that includes a cabinet having an interior volume for storing a beverage container containing a beverage, a door for providing access to the interior volume of the cabinet, and a lock configured to maintain the door in a closed position when the lock is engaged. The cooler may further include a cooling unit configured to maintain the cabinet at a predetermined temperature, and a temperature sensor arranged within the cabinet, wherein the temperature sensor is configured to detect a temperature within the cabinet. The cooler may further include a control unit in communication with the cooling unit and the temperature sensor, wherein the control unit is configured to control the cooling unit so as to maintain a temperature within the cabinet at a predetermined temperature as determined by the temperature sensor, and wherein the control unit is configured to lock the door until a temperature within the cabinet is at the predetermined temperature.

In any of the various embodiments described herein, the door may include a transparent portion such that the interior volume of the cabinet is visible from an exterior of the cooler.

In any of the various embodiments described herein, the door may include a display screen.

In any of the various embodiments described herein, the cooler may further include an indicator configured to provide an indication when the door is locked.

In any of the various embodiments described herein, the predetermined temperature may be in a range of about −1° C. to about −10° C.

In any of the various embodiments described herein, the predetermined temperature may be at or below a freezing point of a beverage within the beverage container.

In any of the various embodiments described herein, the control unit may be configured to set a temperature of the cabinet at a first predetermined temperature or a second predetermined temperature, and the first predetermined temperature may differ from the second predetermined temperature. In some embodiments, the first predetermined temperature may be 0.1° C. to 10° C. In some embodiments, the second predetermined temperature may be −1° C. to −10° C.

Some embodiments described herein relate to a method of operating a cooler that includes setting a temperature inside of a cooler in which a beverage container is stored to a predetermined temperature that is at or below a freezing point of a beverage within the beverage container, locking a door of the cooler when a temperature inside of the cooler is above the predetermined temperature, and unlocking the door of the cooler when the temperature inside of the cooler is at or below the predetermined temperature.

In any of the various embodiments described herein, a method of operating a cooler may further include providing a first indication when the temperature is above the predetermined temperature, and providing a second indication when the temperature is at or below the predetermined temperature.

In any of the various embodiments described herein, providing a first indication may include illuminating a first indicator light, and providing a second indication may include illuminating a second indicator light.

In any of the various embodiments described herein, setting the temperature may include activating a cooling unit, and wherein the method further comprises deactivating the cooling unit when the temperature within the cooler is at or below the predetermined temperature. In some embodiments, a method for operating a cooler may further include operating the cooling unit based on a demand condition of the cooler, wherein the demand condition corresponds to a number of times the door of the cooler is opened in a predetermined period.

In any of the various embodiments described herein, a method for operating a cooler may further include receiving an input indicating a type of beverage to be stored in the cooler, wherein setting the temperature comprises selecting the predetermined temperature based on the input.

Some embodiments described herein relate to a cooler that includes a cabinet having an interior volume for storing a beverage container containing a beverage, a door for providing access to the interior volume of the cabinet, a cooling unit configured to maintain the cabinet at a predetermined temperature, a temperature sensor configured to detect a temperature within the cabinet, and a control unit in communication with the cooling unit and the temperature sensor. The control unit of the cooler may be configured to set the temperature within the cabinet to a first predetermined temperature that is above a freezing point of the beverage, or a second predetermined temperature that is below the freezing point of the beverage.

In any of the various embodiments described herein, the temperature sensor may be arranged at an inlet of an evaporator of the cooling unit, and a second temperature sensor may be arranged at an outlet of the evaporator of the cooling unit.

In any of the various embodiments described herein, the door of the cooler may include a lock, and when the control unit is set to the second predetermined temperature, the control unit may be configured to activate the lock when the temperature within the cabinet is above the second predetermined temperature.

In any of the various embodiments described herein, the cooler may further include a door sensor in communication with the control unit, wherein the door sensor may be configured to detect a number of times the door of the cooler is opened in order to determine a demand condition of the cooler. In some embodiments, the control unit may operate the cooling unit based in part on the demand condition as determined by the door sensor.

BRIEF DESCRIPTION OF THE FIGURES

The accompanying drawings, which are incorporated herein and form a part of the specification, illustrate the present disclosure and, together with the description, further serve to explain the principles thereof and to enable a person skilled in the pertinent art to make and use the same.

DETAILED DESCRIPTION

Reference will now be made in detail to representative embodiments illustrated in the accompanying drawing. It should be understood that the following descriptions are not intended to limit the embodiments to one preferred embodiment. To the contrary, it is intended to cover alternatives, modifications, and equivalents as can be included within the spirit and scope of the described embodiments as defined by the claims.

Coolers are often used to cool or chill packaged beverages, such as bottled or canned beverages. However, such coolers may not be well suited for storing beverages at or below a freezing point of the beverage, such that the beverage is supercooled. Such coolers may not be able to achieve sub-zero temperatures required to supercool beverages, and/or may be unable to precisely control a temperature of the cooler to prevent freezing of beverages within the cooler.

Thus, if a storeowner, vendor or the like wishes to sell supercooled beverages, the storeowner generally must purchase a separate cooler dedicated for storing supercooled beverages. Having multiple coolers for storing beverages at different temperatures may be expensive and inconvenient. Further, the storeowner may not have the space for providing multiple coolers at different temperatures. Thus, a cooler that can be set to a temperature for storing chilled or supercooled beverage is desired.

Further, in order to maintain the beverage at a meta stable state of matter between liquid and solid phase, it is important to precisely control the temperature at which supercooled beverages are stored. If the temperature is not sufficiently low, the beverage may not undergo nucleation and form a slush beverage when agitated. If the temperature is too low, the beverage may freeze within the cooler. The frozen beverage may not be able to be sold, and in some cases, the beverage container may explode due to expansion of the beverage during freezing, which creates a safety hazard and may make a mess within the cooler.

Figure 1:
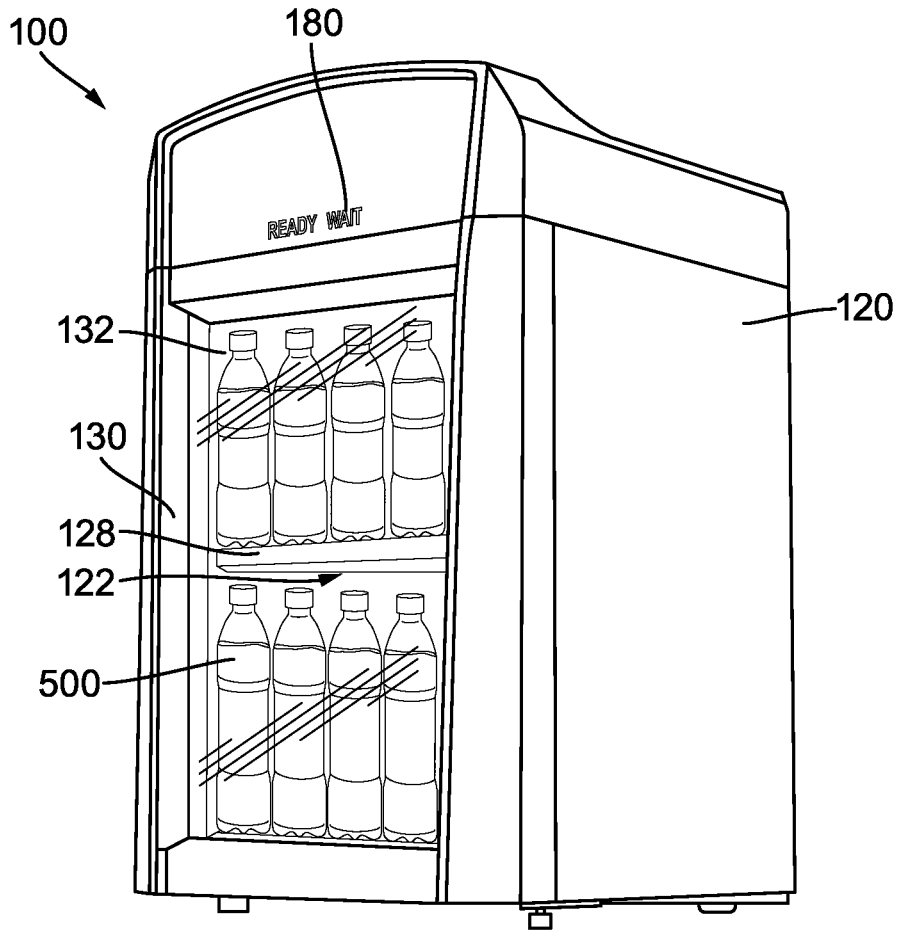
FIG. 1 shows a perspective view of a cooler according to an embodiment.

In some embodiments, a cooler 100 includes a cabinet 120 and a door 130, as shown in FIG. 1. Cabinet 120 defines an interior volume 122 for storing any of various products, such as beverage containers 500. While the disclosure refers primarily to cooler 100 for use in storing beverage containers 500, it is understood that cooler 100 may be used to store any of various products, such as food and snack items, merchandise, or other perishable goods. As used herein, the term beverage container may refer to bottles, such as glass bottles or plastic bottles, cans, pouches, or cartons. Beverage containers 500 may store any of various types of beverages, such as carbonated beverages, such as sodas, energy drinks, or sparkling water; non-carbonated beverages, such as water, flavored water, sports drinks, tea, or lemonade; or dairy or milk-based beverages, such as milk, flavored milk, coffee, or protein shakes, among other beverages.

In some embodiments, cabinet 120 has an interior volume of about 10 L to about 100 L, or about 20 L to about 90 L, or about 40 L to about 80 L. By keeping an interior volume of cabinet 120 relatively small in comparison to existing coolers or refrigerators, temperature within cabinet 120 can be more precisely controlled and temperature variation within cabinet 120 is minimized or eliminated. In some embodiments, cabinet 120 may be configured to store about 10 bottles to about 60 bottles, about 20 bottles to about 50 bottles, or about 30 bottles to about 45 bottles, such as 600 mL bottles. In order to promote cooling of beverage containers 500, beverage containers 500 may be placed in a standing or upright orientation within cabinet 120. Beverage containers 500 may be arranged so that they are spaced from one another and from the walls of cabinet 120 in order to promote airflow.

Cabinet 120 may include one or more shelves 128 on which products may be placed for storage and display. In some embodiments, shelves 128 may be solid, and each shelf may be a plate or panel of glass, plastic, or metal, among other materials. In some embodiments, shelves 128 may include apertures for promoting airflow through shelves 128. In some embodiments, shelves 128 may include a wire rack to allow air to flow through the shelves. Shelves 128 may be arranged at different elevations within cabinet 120 and may be vertically spaced from one another within cabinet 120.

In some embodiments, cabinet 120 may include a cabinet light 172. Cabinet light 172 may be a light emitting diode (LED), an incandescent light, a fluorescent tube, among other light sources. Cabinet light 172 may be used to illuminate interior volume 122 of cabinet 120 to allow products therein to be more easily viewed by consumers.

A door 130 may be movably connected to cabinet 120. Door 130 may be moved from a closed position in which interior volume 122 of cabinet 120 is inaccessible, and an open position in which interior volume 122 can be accessed by a consumer. Door 130 may be connected to cabinet 120 such as by a hinge. In some embodiments, door 130 may be slidably connected to cabinet 120 and may slide on tracks of cabinet 120. In some embodiments, cooler 100 may include a single door 130. In some embodiments, cooler 100 may include two or more doors 130. In such embodiments, doors 130 may be arranged side-by-side. For example, a cabinet 120 may include a pair of opposing side walls, a rear wall, and an open front wall, wherein a first door 130 may be arranged on a left side of the open front wall and a second door 130 may be arranged on a right side of the open front wall. When first and second doors 130 are closed, doors 130 serve as a front wall of cabinet 120 enclosing interior volume 122. In some embodiments, door 130 may be arranged at a front end of cooler 100, as shown in FIG. 1. However, in some embodiments, door 130 may be arranged on an upper wall of cooler 100 so that cooler 100 is accessed in a top-down manner.

In some embodiments, door 130 may include a transparent portion 132 so that a consumer may see through transparent portion 132 of door 130 into interior volume 122 of cabinet 120, as shown in FIG. 1. In this way, a consumer may view beverage containers 500 within cabinet 120 without having to open door 130 of cabinet 120. This is beneficial as opening door 130 may result in variation of a temperature within cooler 100 by allowing relatively warm air to enter cooler 100. Transparent portion 132 may be formed of glass, polymethyl methacrylate, polycarbonate, or other transparent materials. In some embodiments, transparent portion 132 of door 130 may include two or more layers separated by an air gap to provide thermal insulation. Further, in some embodiments, transparent portion 132 may include a coating, such as a low-emissivity (low-e) coating to minimize the amount of infrared and ultraviolet (UV) light that passes through door 130 into cabinet 120.

Figure 2:
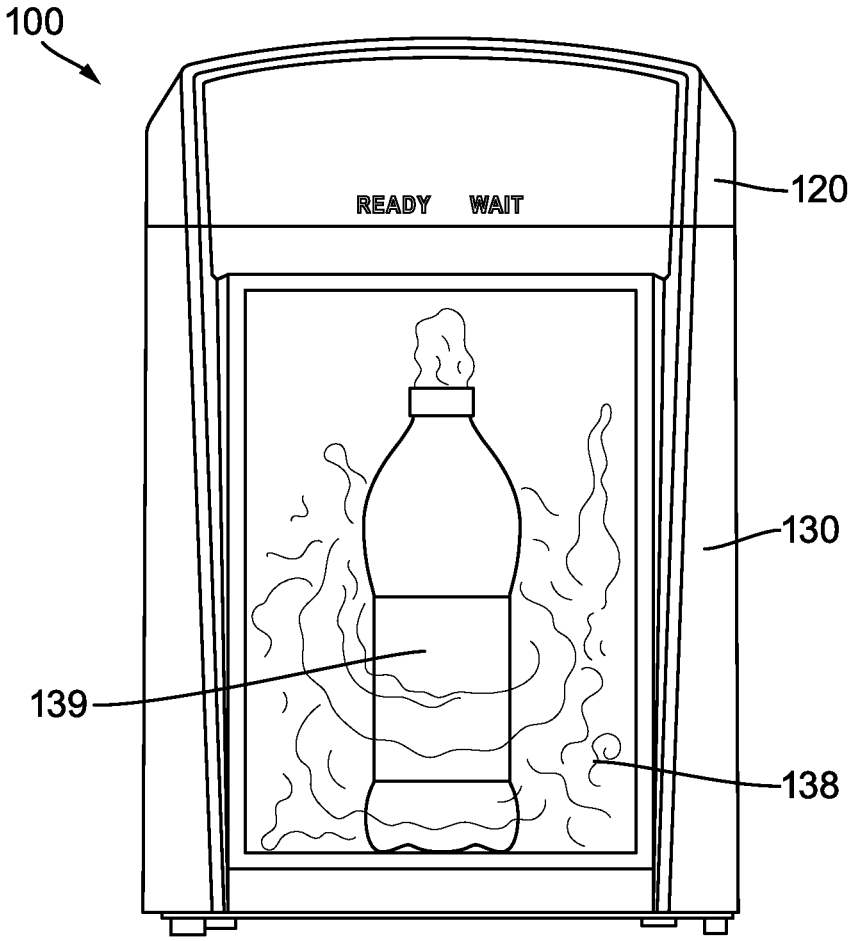
FIG. 2 shows a front view of a cooler having a display according to an embodiment.

In some embodiments, as shown for example in FIG. 2, door 130 may alternatively or additionally include a display screen 138. Display screen 138 may include a liquid crystal display (LCD), a light emitting diode (LED) display, an organic LED (OLED) display, among others. In some embodiments, display screen 138 may be a touch screen to allow for consumer interaction. Display screen 138 may be transparent and may be incorporated into transparent portion 132 of door 130 so that when display screen 138 is not used to display video or images, consumers may see through display screen 138 into an interior volume 122 of cooler 100. Alternatively, the display screen 138 may not be transparent, and may be opaque. Display screen 138 may be configured to display images or video 139. For example, display screen 138 may be configured to display advertisements to attract consumers to cooler 100 to purchase a beverage. Display screen 138 may also be used to show products available for purchase.

In some embodiments, door 130 of cooler 100 may include a lock 134. When lock 134 is activated or engaged, door is "locked," and when lock 134 is inactive or is disengaged, door is "unlocked." Door 130 may be locked while cooler 100 is being cooled to a desired temperature for storing beverage containers 500, as discussed in further detail below. Opening door 130 may cause temperature variation within cooler 100 and as a result may slow the cooling of beverage containers 500 within cooler 100 to the desired temperature. Thus, by engaging lock 134, door 130 is locked and cooler 100 may quickly cool to the desired temperature without interruption. Lock 134 may be, for example, an electromechanical lock or an electromagnetic lock.

Figure 3:
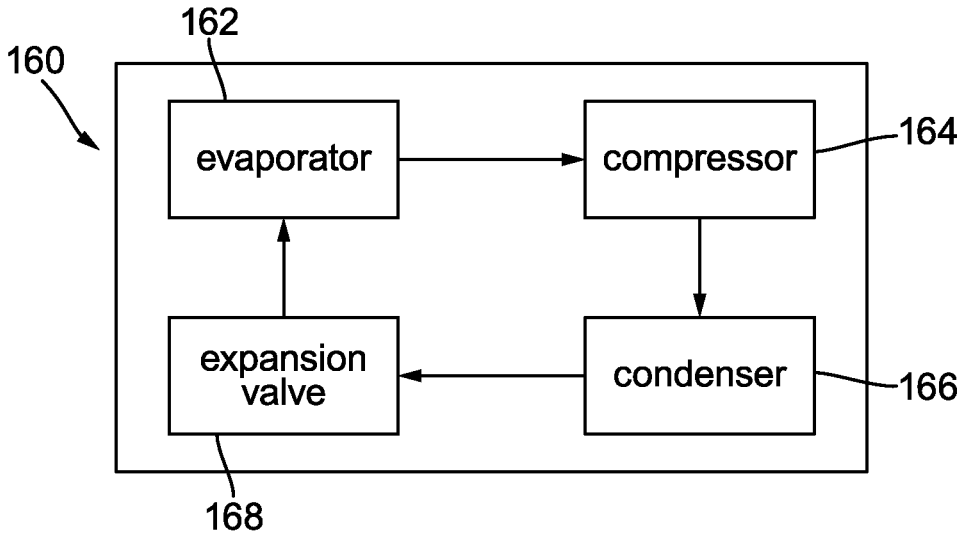
FIG. 3 shows a schematic diagram of components of a cooling unit of a cooler according to an embodiment.

Cooler 100 may further include a cooling unit 160. Cooling unit 160 may be a vapor-compression refrigeration system, as shown for example in FIG. 3. In such embodiments, cooling unit 160 may include an evaporator 162 in communication with a compressor 164, a condenser 166 and an expansion valve 168 for circulating a refrigerant, such as R600a or R134a, among others. Evaporator 162 distributes cooled air to interior volume 122 of cabinet 120. Evaporator 162 may include a fan to promote air circulation. In some embodiments, condenser 166 may be a microchannel condenser.

Figure 4:
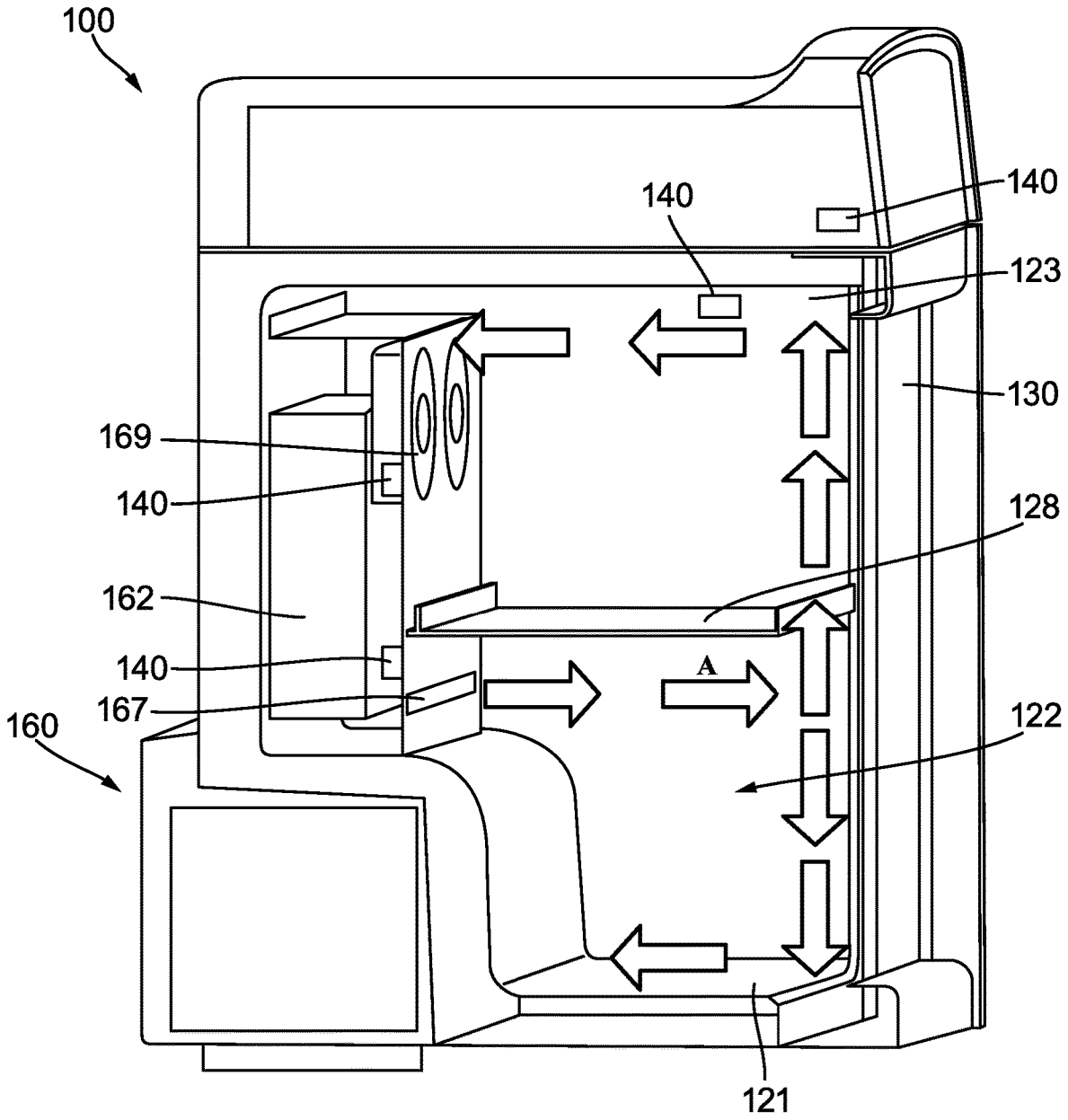
FIG. 4 shows a sectional view of a cooler according to an embodiment illustrating airflow within the cooler.

Cooled air from cooling unit 160 may flow into cabinet 120 from evaporator 162 via vents 167 on an interior wall of cabinet 120, as shown in FIG. 4. In some embodiments, inlet vents 167 may be arranged on a rear wall of cabinet 120. Cooled air may flow along shelf 128 within cabinet 120 toward door 130 of cooler 100. Cooled air then flows along an interior surface of door 130 toward an upper end 123 and lower end 121 of cabinet 120. Air then circulates within interior volume 122 of cabinet 120 to cool beverage containers 500 or other products and may exit via outlet vents 169.

Figure 5:
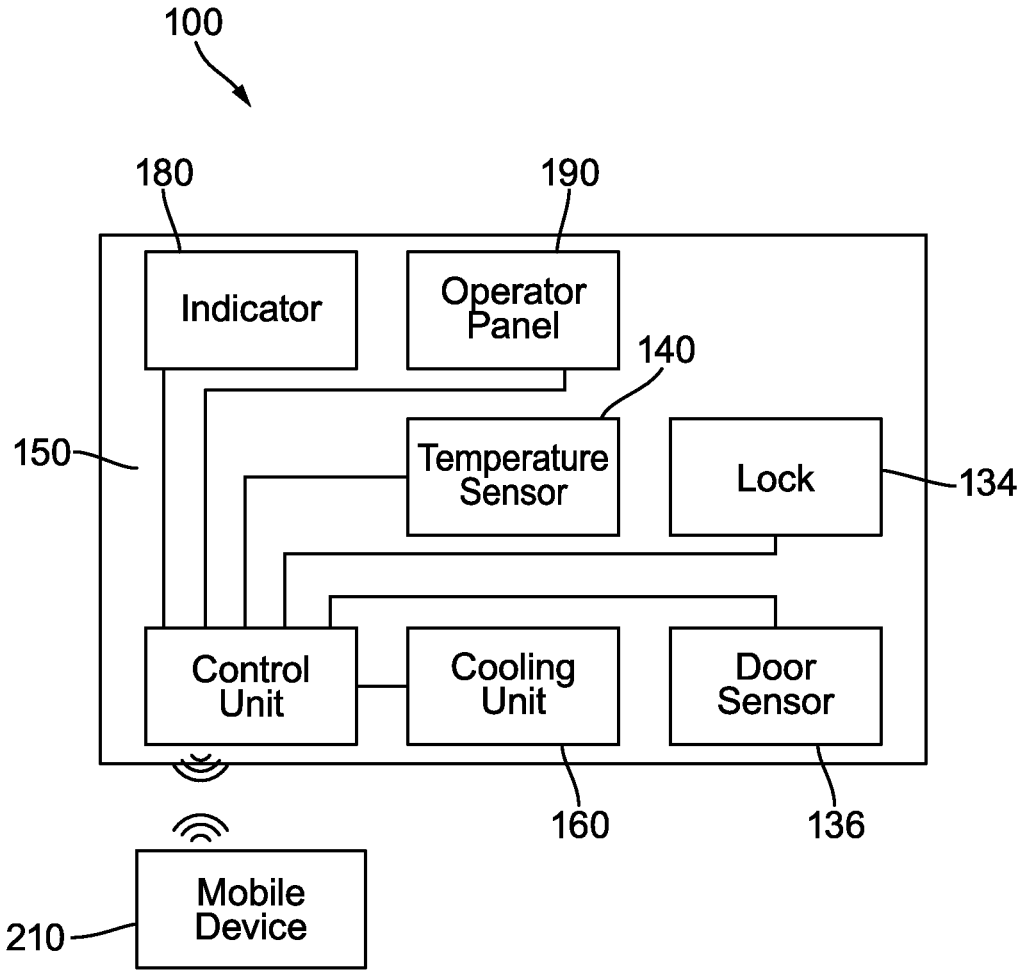
FIG. 5 shows a schematic diagram of components of a cooler according to an embodiment.

In some embodiments, cooler 100 may include a control unit 150 configured to control operation of cooler 100, as shown in FIG. 5. Control unit 150 may be in communication with door lock 134 to engage and disengage lock 134. Control unit 150 may be in communication with a door sensor 136 configured to detect when door 130 is opened. Further, control unit 150 may be in communication with cooling unit 160 to activate and deactivate cooling unit 160. Further, control unit 150 may be in communication with temperature sensor(s) 140 for receiving information from temperature sensors 140 regarding a temperature within cabinet 120. Control unit 150 may further be in communication with an operator panel 190 for receiving operator input, as discussed in further detail below. Further, control unit 150 may be in communication with an indicator 180 for providing an indication of whether beverages within cooler 100 are at the desired storage temperature, as discussed below.

In some embodiments, control unit 150 of cooler 100 may be configured to set a temperature of cooler 100. In some embodiments, control unit 150 may be configured to set the cooler temperature to a first predetermined temperature or a second predetermined temperature. First predetermined temperature may be a temperature suitable for storing beverage containers 500 at a chilled temperature in a liquid state. For example, first predetermined temperature may be above a freezing point of the beverage and may be about 0.1° C. to about 10° C. Second predetermined temperature may be for storing beverage containers at or below a freezing point of a beverage within a beverage container 500, such that the beverage is supercooled. For example, second predetermined temperature may be about −1° C. to −10° C.

In some embodiments, cabinet 120 includes one or more temperature sensors 140 configured to determine a temperature at a location within cabinet 120 (see, e.g., FIG. 4). In some embodiments, temperature sensor 140 may be, for example, a thermostat or thermistor. In some embodiments, cooler 100 includes a first temperature sensor 140 for determining an ambient temperature outside of the cabinet 120. First temperature sensor 140 may be arranged on an exterior of cabinet 120. Cooler 100 may further include a second temperature sensor 140 at an inlet of evaporator 162, a third temperature sensor 140 at an outlet of evaporator 162, and a fourth temperature sensor 140 within an interior volume of cabinet 120. In this way, temperature sensors 140 may precisely control a temperature within cabinet 120 by detecting differences in temperatures determined by the temperature sensors 140. By arranging temperature sensors 140 at an inlet and an outlet of evaporator 162, control unit 150 may precisely control a temperature of cooler 100 by detecting minor variations in temperature as determined by the various temperature sensors 140, and may activate or deactivate cooling unit 160 to maintain the predetermined temperature. However, in some embodiments, cooler 100 may include fewer or additional temperature sensors 140. Temperature sensors 140 may be arranged at any of various locations within cabinet 120, such as adjacent an upper end 123 or lower end 121 of cabinet 120, or toward door 130 or an opposing rear portion of cabinet 120. Further, temperature sensors 140 may be arranged on a shelf 128 of cabinet 120.

Control unit 150 may be configured to maintain storage temperature of cooler 100 within ±2° C. of the predetermined temperature or within ±1° C. of the predetermined temperature. For example, if the predetermined temperature is −4° C., control unit 150 may be configured to maintain the temperature within cooler 100 in a range of about −2° C. to about −6° C. Precise temperature control is important to ensure that beverages are supercooled and remain at the predetermined temperature for supercooling the beverage. Control unit 150 may control activation of a compressor 164 of cooling unit 160, a fan of cooling unit 160, and/or adjust the time of defrost cycles of cooling unit 160 in order to control a temperature of cabinet 120. At temperatures lower than the predetermined temperature for supercooling beverages, the beverages may begin to freeze within cooler 100, which is undesirable. At higher temperatures, beverages may not be sufficiently cooled and may not form a slush beverage when agitated.

In some embodiments, control unit 150 may be configured to activate cooling unit 160 for a predetermined period of time, such as 3 hours to 6 hours, 3.5 hours to 5.5 hours, or 4 hours to 5 hours. One of ordinary skill in the art will appreciate that the amount of time required to supercool the beverage may depend upon various factors, including the type of beverage, the temperature of the beverage prior to cooling, and the temperature within the cooler.

In some embodiments, cooler 100 may include an indicator 180 configured to provide an indication when door 130 is locked and beverages are not ready to be sold and when door 130 is unlocked and beverages are ready to be sold. In some embodiments, indicator 180 may include an indicator light 182 or lights. Indicator light 182 may include, for example, one or more light emitting diodes (LED)s. In some embodiments, indicator light 182 may include a word or phrase to indicate a status of cooler 100, such as "locked" and "unlocked," or "wait" and "ready."

Figure 6:
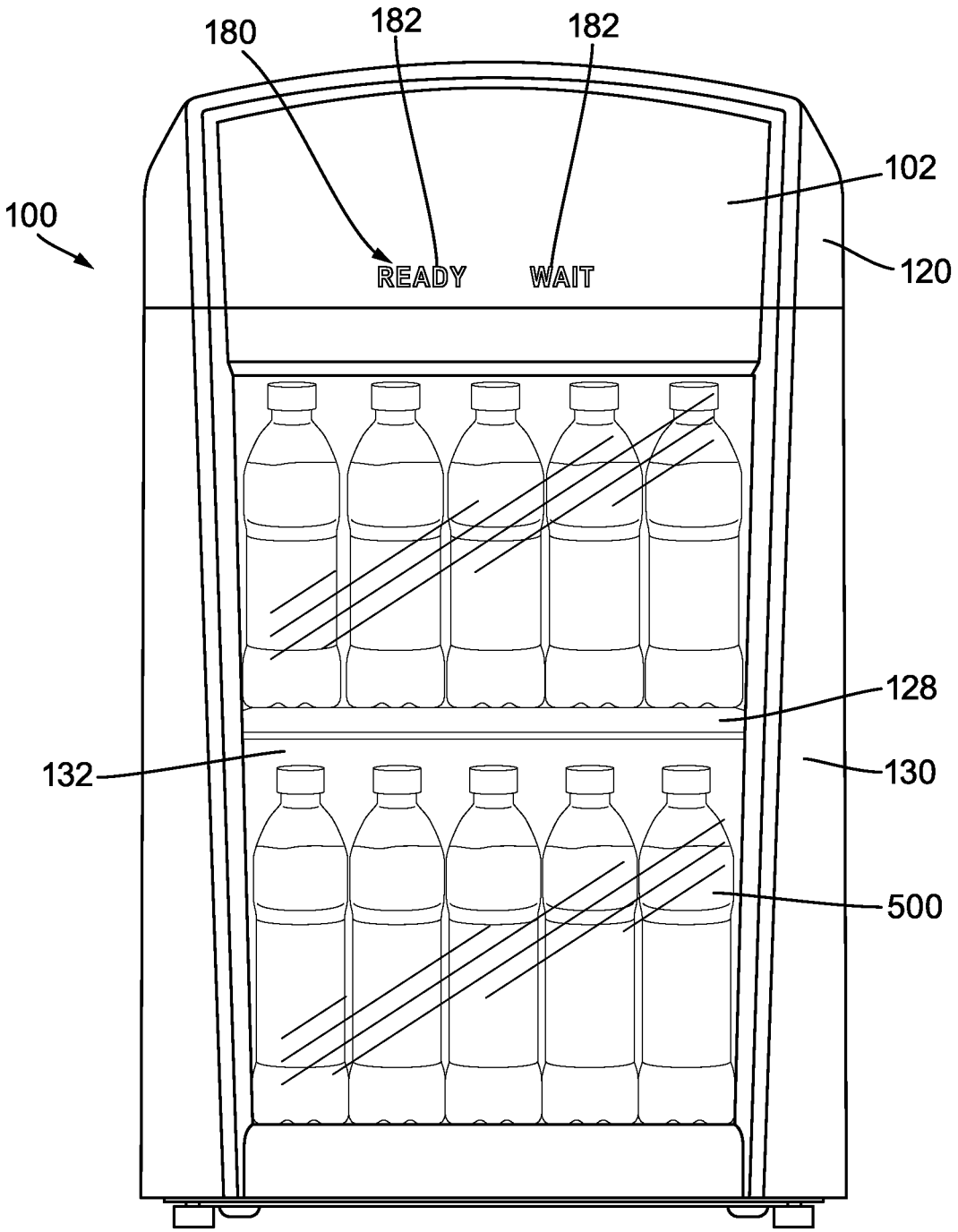
FIG. 6 shows a front view of the cooler of FIG. 1.

As shown for example in FIG. 6, indicator 180 may include a first light 182 and a second light 182. First light 182 is illuminated when door 130 is locked and beverages are not available for sale, and when door 130 is unlocked first light 182 is no longer illuminated, and instead second light 182 is illuminated to indicate that door 130 is unlocked and beverages are available for sale. In some embodiments, first light 182 may be a first color, such as red, and second light 182 may be a second color, such as green. However, it is understood that any of various colors may be selected for first and second lights. In some embodiments, a single indicator light 182 may be provided. The single indicator light 182 may illuminate in a first color when door 130 is locked and may illuminate in a second color when door 130 is unlocked.

Figure 7:
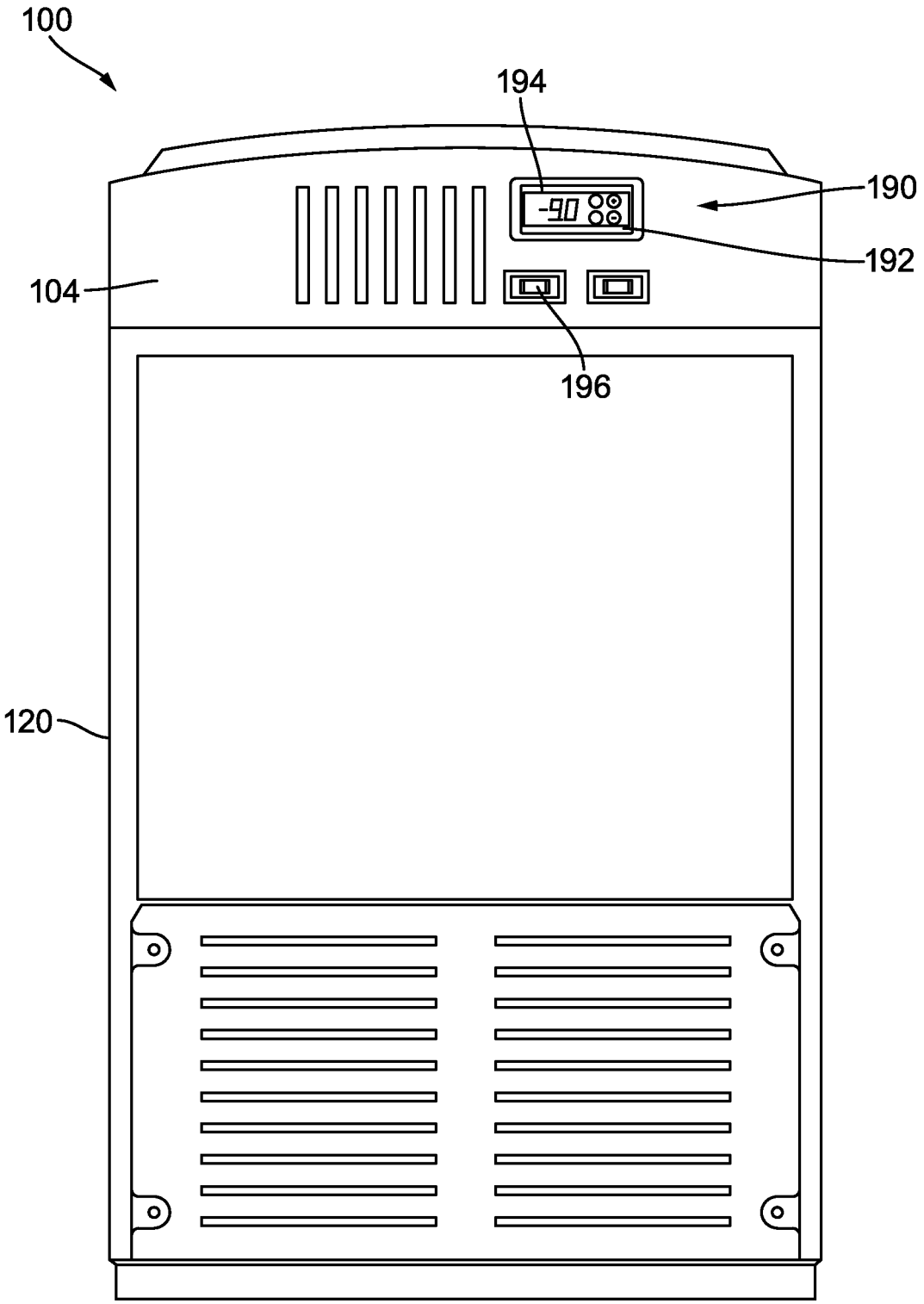
FIG. 7 shows a rear view of the cooler of FIG. 1.

In some embodiments, cooler 100 may include an operator panel 190 for receiving input from an operator, as shown in FIG. 7. Operator panel 190 may be in communication with control unit 150, such that control unit 150 may receive user input from operator panel 190. In some embodiments, operator panel 190 may be located on cabinet 120 of cooler 100. For example, operator panel 190 may be located on a rear wall 104 of cabinet 120 so that operator panel 190 is not readily accessed by consumers. Operator panel 190 may include an actuator 192 for setting a temperature of cooler 100. Operator panel 190 may allow an operator to select a first predetermined temperature for chilling beverages or a second predetermined temperature for supercooling beverages. Operator panel 190 may include a display 194 for displaying information, such as the operator's temperature selection, the current temperature of the cooler, or the operating mode as discussed below.

In some embodiments, operator panel 190 may allow for selection of a beverage or product to be stored within cooler 100. The temperature required to supercool a beverage depends on the type of beverage, and thus the second predetermined temperature may depend on the type of beverage to be stored in cooler 100. In some embodiments, control unit 150 may include a memory that stores a list of different types of beverages, and a temperature or range of temperatures for supercooling each type of beverage. Thus, upon receipt of a user input indicating a type of beverage, control unit 150 may automatically select a predetermined temperature for storing that type of beverage at a supercooled temperature.

Figure 8:
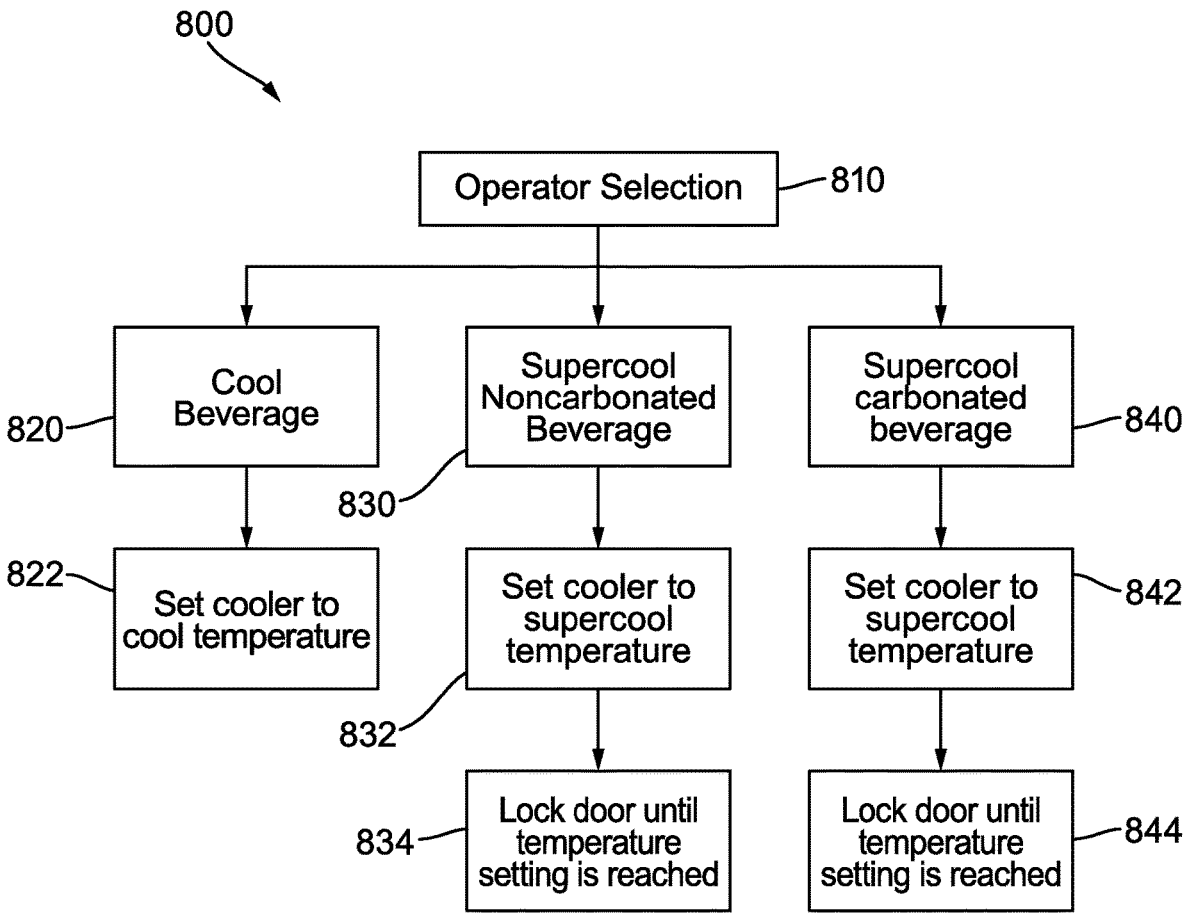
FIG. 8 shows a diagram of operating modes of the cooler according to an embodiment.

In some embodiments, cooler 100 may store a number of operating modes, as shown for example in FIG. 8. Each operating mode may include a beverage type and a storage temperature or range of storage temperatures for supercooling the beverage. Different beverages may have different freezing points depending on the ingredients of the beverage and the amount of carbonation, among other factors. Thus, each beverage may have a different storage temperature to supercool the beverage and activate slush formation. Further, each operating mode may include a storage time. As shown in FIG. 8, an operator of cooler 100 may select an operating mode of the cooler 810. Operation modes may include, for example, a beverage cooling mode 820. Beverage cooling mode 820 may be independent of the type of beverage, and may set the cooler to a temperature for cooling or chilling beverages (e.g., a temperature above a freezing point of the beverage). Thus, cooler need not be used to supercool beverages, and can be used simply to chill or cool beverages.

Operation modes may also include a non-carbonated beverage supercooling mode 830. In mode 830, cooler may be set to a temperature for supercooling non-carbonated beverages 832, such as sports drinks or coffee-based drinks. Door of cooler is locked 834 until the temperature within the cooler reaches the predetermined temperature for supercooling the non-carbonated beverages.

Operation modes may further include a carbonated beverage supercooling mode 840. In mode 840, cooler may be set to a temperature for supercooling carbonated beverages 842. Door of cooler is locked 844 until the temperature within the cooler reaches the predetermined temperature for supercooling the carbonated beverages.

In some embodiments, different operating modes may be provided for each type of beverage to be stored in the cooler. For example, there may be an operating mode for supercooling Pepsi, diet Pepsi, Sierra Mist, Mountain Dew, etc.

In some embodiments, operator panel 190 may further include one or more override switches 196 (see, e.g., FIG. 7) configured to control operation of cooler 100. Each override switch 196 may be a push-button, a lever, a rocker switch, a dial, a touch-sensitive device, among others. A first override switch 196 may unlock lock 134 of door 130 of cooler 100. This may allow the owner of cooler 100 or service personnel to open door 130 of cooler 100 despite door 130 being locked. A second override switch 196 may control operation of a cabinet light 172 within cooler 100. Cooler 100 may include cabinet light 172 for illuminating interior volume 122 of cooler 100, and override switch 196 may be used to turn on or off cabinet light 172.

In some embodiments, in addition to or instead of an operator panel 190, control unit 150 may be remotely controlled, such as by a computer, such as a laptop or desktop computer, or by a mobile device 210, such as a tablet, smartphone, or the like (see, e.g., FIG. 5). In such embodiments, the computer or mobile device may be in communication with the control unit 150. Products to be stored in the cooler, storage temperatures, and/or operating modes may be selected via mobile device 210.

In some embodiments, a database may include a list of different types of beverages and temperatures or temperature ranges for supercooling the different types of beverages. In some embodiments, control unit 150 may include a memory for storing the database. In some embodiments, database may be stored remotely from cooler 100, such as on a server or cloud storage.

In some embodiments, cooler 100 may be configured to detect a number of times door of cooler 100 is opened. Further, cooler 100 may track a time of each opening of door 130, or a time between door openings. In this way, cooler 100 may determine a frequency of the opening of door 130. Based on the number of times door 130 is opened in a predetermined period, such as one hour, cooler 100 may determine a consumer demand condition of cooler 100. In a high demand condition, door is opened several times in the predetermined period. In a low demand period, the door is opened only a few or no times during the predetermined period. A high demand condition may be present when door is opened a predetermined number of times in the predetermined period, or when the opening of door 130 occurs at a predetermined frequency or higher. Conversely, a low demand condition may be present when door 130 is opened fewer than a predetermined number of times in the predetermined period, or when opening of door 130 occurs at a frequency less than the predetermined frequency. In some embodiments, cooler 100 may further include an intermediate or moderate demand condition. For example, if door 130 is opened four or fewer times in an hour a low demand condition is present, if door 130 is opened between four and eight times in an hour a normal demand condition is present, and if door 130 is opened eight or more times in an hour a high demand condition is present. One of ordinary skill in the art will appreciate that the number of door openings can be adjusted and cooler may determine additional or fewer demand conditions. Operation of cooling unit may be based in part on the demand condition (e.g., high or low demand) as discussed in further detail below.

Figure 9:
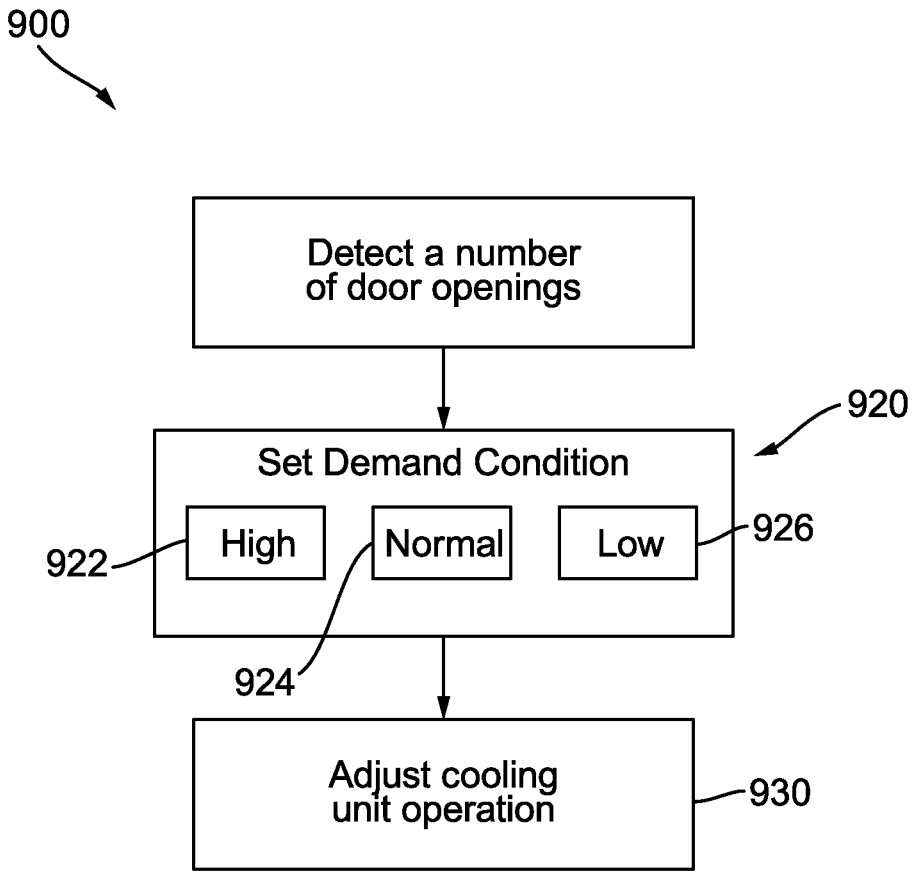
FIG. 9 shows a method of operating a cooler based on consumer demand according to an embodiment.
Figure 10:
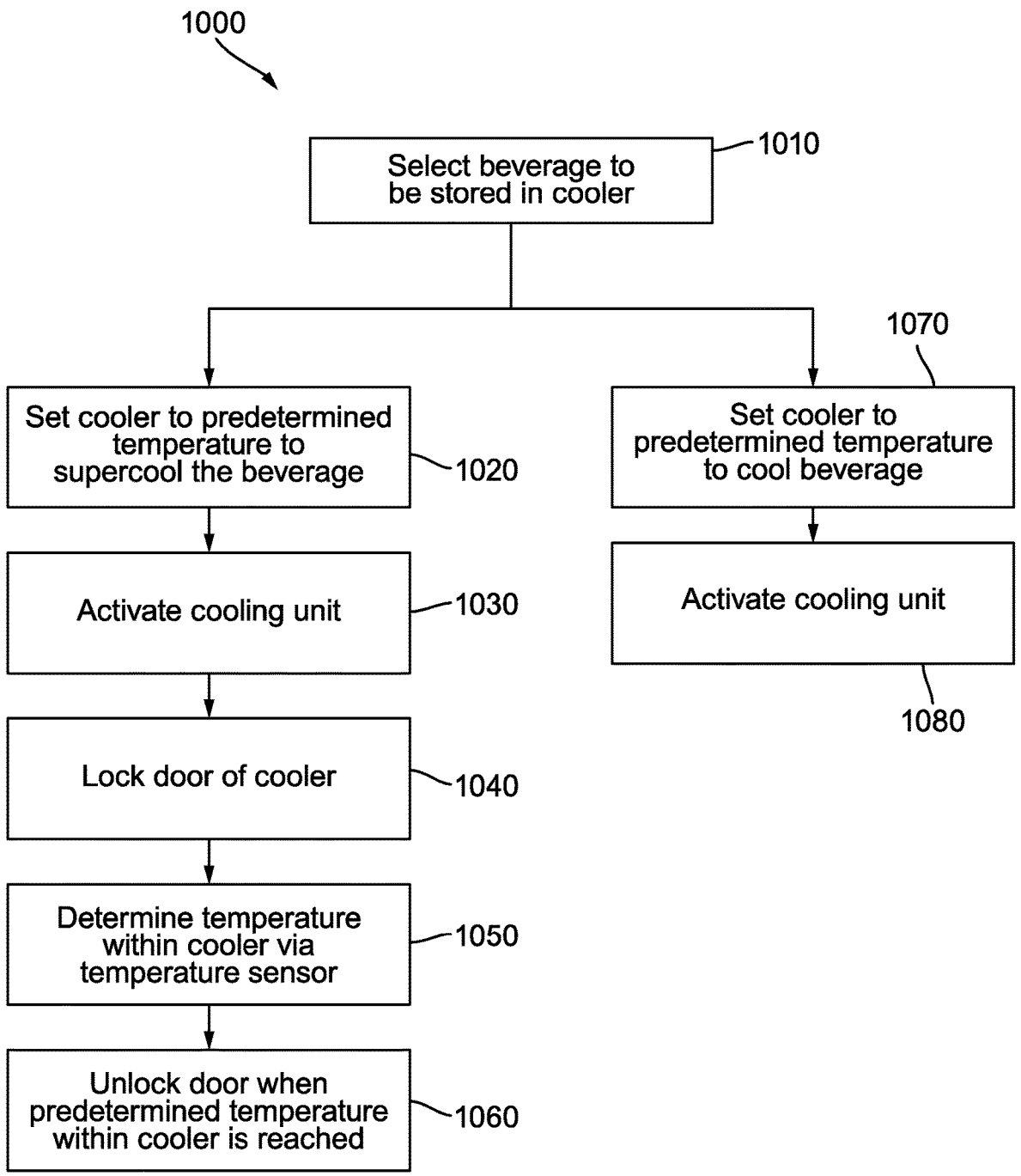
FIG. 10 shows a method of operating a cooler according to an embodiment.

An exemplary method of operating a cooler based at least in part on a demand condition is shown in FIG. 9. In operation 910, cooler detects a number of door openings. Cooler may detect each time a door is opened by a door sensor, such as a motion sensor. The cooler may detect a number of door openings in a predetermined period, a frequency of door openings, or an average time between door openings. In operation 920, the cooler may set a demand condition of the cooler, such as high demand 922, normal demand 924, or low demand 926 based on the number of door openings detected by the cooler. In operation 930, cooler may adjust cooling unit operation based at least in part on the demand condition. For example, in a high demand condition in which cooler door is opened relatively frequently, thus allowing relatively warm ambient air to enter the cooler, the compressor of the cooling unit may be activated by the control unit more frequently to increase circulation of cooled air within the cabinet in order to maintain the temperature at the predetermined temperature. Conversely, in a low demand condition, the cooling unit may be activated less frequently to prevent lowering the temperature within the cabinet below the predetermined temperature and to conserve energy.

In an exemplary method of operation of a cooler 1000, an operator may select a beverage to be stored in the cooler 1010, e.g., Pepsi. Operator may select to store the beverage at a supercooled temperature 1020 or at a cool temperature 1070. Operator may make a selection using an operator panel of the cooler, or may use a computer or mobile device to remotely operate the cooler. If a cool temperature is selected, cooler is set to a first predetermined temperature 1070. Cooling unit is activated to cool the cooler to the first predetermined temperature 1080. Cooling unit may be deactivated when the first predetermined temperature is reached as determined by a temperature sensor or sensors within cooler. Temperature sensors may continually or periodically monitor temperature within cooler and cooling unit may be reactivated as needed to maintain temperature within cooler at the first predetermined temperatures. As beverage is cooled or chilled, it may not be necessary to precisely control temperature within cooler and thus door may not be locked while cooler is cooling to the first predetermined temperature. However, in some embodiments, door may be locked until the predetermined temperature for cooling the beverages is reached.

If operator selects to set the cooler to a predetermined temperature for supercooling the beverages 1020, cooler may automatically set the cooler to a predetermined storage temperature based on the type of beverage selected. The cooling unit of the cooler may be activated to cool to the cooler to a second predetermined temperature 1030. The door of the cooler may be locked 1040 to prevent door of cooler from being opened while the cooler is being cooled to the second predetermined temperature. A temperature sensor or sensors within the cooler determine a temperature within cooler 1050. When the second predetermined temperature is reached, the door may be unlocked so that consumers may open door and retrieve the supercooled beverages 1060. A slush beverage can then be created within the beverage container by agitating the beverage, such as by shaking or striking the beverage container. Temperature sensors may monitor the temperature within the cooler and the cooling unit may be activated as needed to maintain the temperature at the second predetermined temperature.

Figure 11:
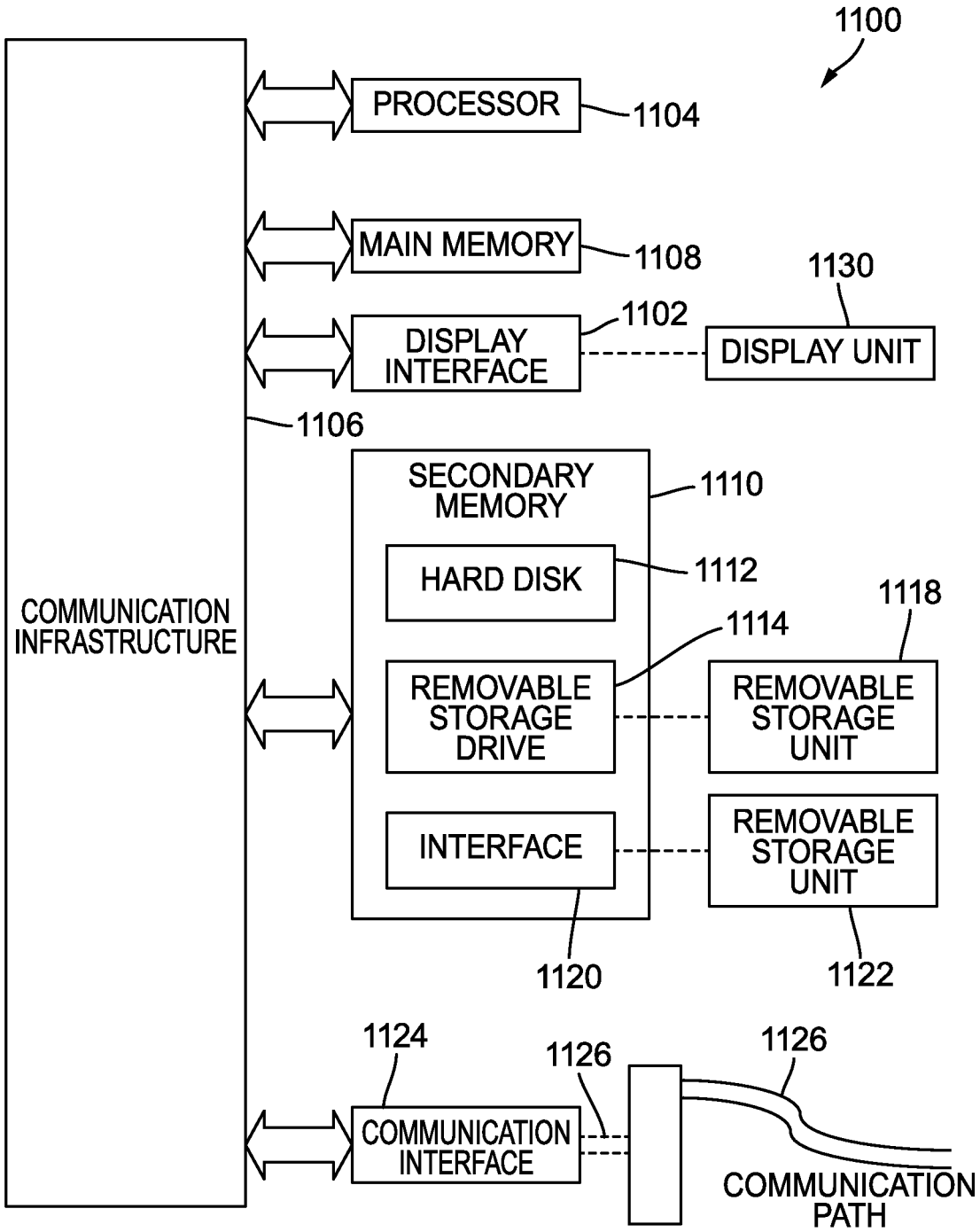
FIG. 11 shows a schematic block diagram of an exemplary computer system in which embodiments may be implemented.

FIG. 11 illustrates an exemplary computer system 1100 in which embodiments, or portions thereof, may be implemented as computer-readable code. Control unit 150 as discussed herein may be a computer system having all or some of the components of computer system 1100 for implementing processes discussed herein.

If programmable logic is used, such logic may execute on a commercially available processing platform or a special purpose device. One of ordinary skill in the art may appreciate that embodiments of the disclosed subject matter can be practiced with various computer system configurations, including multi-core multiprocessor systems, minicomputers, and mainframe computers, computer linked or clustered with distributed functions, as well as pervasive or miniature computers that may be embedded into virtually any device.

For instance, at least one processor device and a memory may be used to implement the above described embodiments. A processor device may be a single processor, a plurality of processors, or combinations thereof. Processor devices may have one or more processor "cores."

Various embodiments of the invention(s) may be implemented in terms of this example computer system 1100. After reading this description, it will become apparent to a person skilled in the relevant art how to implement one or more of the invention(s) using other computer systems and/or computer architectures. Although operations may be described as a sequential process, some of the operations may in fact be performed in parallel, concurrently, and/or in a distributed environment, and with program code stored locally or remotely for access by single or multi-processor machines. In addition, in some embodiments the order of operations may be rearranged without departing from the spirit of the disclosed subject matter.

Processor device 1104 may be a special purpose or a general purpose processor device. As will be appreciated by persons skilled in the relevant art, processor device 1104 may also be a single processor in a multi-core/multiprocessor system, such system operating alone, or in a cluster of computing devices operating in a cluster or server farm. Processor device 1104 is connected to a communication infrastructure 1106, for example, a bus, message queue, network, or multi-core message-passing scheme.

Computer system 1100 also includes a main memory 1108, for example, random access memory (RAM), and may also include a secondary memory 1110. Secondary memory 1110 may include, for example, a hard disk drive 1112, or removable storage drive 1114. Removable storage drive 1114 may include a floppy disk drive, a magnetic tape drive, an optical disk drive, a flash memory, or the like. The removable storage drive 1114 reads from and/or writes to a removable storage unit 1118 in a well-known manner. Removable storage unit 1118 may include a floppy disk, magnetic tape, optical disk, a universal serial bus (USB) drive, etc. which is read by and written to by removable storage drive 1114. As will be appreciated by persons skilled in the relevant art, removable storage unit 1118 includes a computer usable storage medium having stored therein computer software and/or data.

Computer system 1100 (optionally) includes a display interface 1102 (which can include input and output devices such as keyboards, mice, etc.) that forwards graphics, text, and other data from communication infrastructure 1106 (or from a frame buffer not shown) for display on display unit 1130.

In alternative implementations, secondary memory 1110 may include other similar means for allowing computer programs or other instructions to be loaded into computer system 1100. Such means may include, for example, a removable storage unit 1122 and an interface 1120. Examples of such means may include a program cartridge and cartridge interface (such as that found in video game devices), a removable memory chip (such as an EPROM, or PROM) and associated socket, and other removable storage units 1122 and interfaces 1120 which allow software and data to be transferred from the removable storage unit 1122 to computer system 1100.

Computer system 1100 may also include a communication interface 1124. Communication interface 1124 allows software and data to be transferred between computer system 1100 and external devices. Communication interface 1124 may include a modem, a network interface (such as an Ethernet card), a communication port, a PCMCIA slot and card, or the like. Software and data transferred via communication interface 1124 may be in the form of signals, which may be electronic, electromagnetic, optical, or other signals capable of being received by communication interface 1124. These signals may be provided to communication interface 1124 via a communication path 1126. Communication path 1126 carries signals and may be implemented using wire or cable, fiber optics, a phone line, a cellular phone link, an RF link or other communication channels.

In this document, the terms "computer program medium" and "computer usable medium" are used to generally refer to media such as removable storage unit 1118, removable storage unit 1122, and a hard disk installed in hard disk drive 1112. Computer program medium and computer usable medium may also refer to memories, such as main memory 1108 and secondary memory 1110, which may be memory semiconductors (e.g. DRAMs, etc.).

Computer programs (also called computer control logic) are stored in main memory 1108 and/or secondary memory 1110. Computer programs may also be received via communication interface 1124. Such computer programs, when executed, enable computer system 1100 to implement the embodiments as discussed herein. In particular, the computer programs, when executed, enable processor device 1104 to implement the processes of the embodiments discussed here. Accordingly, such computer programs represent controllers of the computer system 1100. Where the embodiments are implemented using software, the software may be stored in a computer program product and loaded into computer system 1100 using removable storage drive 1114, interface 1120, and hard disk drive 1112, or communication interface 1124.

Embodiments of the invention(s) also may be directed to computer program products comprising software stored on any computer useable medium. Such software, when executed in one or more data processing device, causes a data processing device(s) to operate as described herein. Embodiments of the invention(s) may employ any computer useable or readable medium. Examples of computer useable mediums include, but are not limited to, primary storage devices (e.g., any type of random access memory), secondary storage devices (e.g., hard drives, floppy disks, CD ROMS, ZIP disks, tapes, magnetic storage devices, and optical storage devices, MEMS, nanotechnological storage device, etc.).

It is to be appreciated that the Detailed Description section, and not the Summary and Abstract sections, is intended to be used to interpret the claims. The Summary and Abstract sections may set forth one or more but not all exemplary embodiments of the present invention(s) as contemplated by the inventors, and thus, are not intended to limit the present invention(s) and the appended claims in any way.

The present invention has been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the invention(s) that others can, by applying knowledge within the skill of the art, readily modify and/or adapt for various applications such specific embodiments, without undue experimentation, and without departing from the general concept of the present invention(s). Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance herein.

What is claimed is:

1. A cooler, comprising:

a cabinet having an interior volume for storing a beverage container containing a beverage;

a door for providing access to the interior volume of the cabinet;

a lock configured to maintain the door in a closed position when the lock is engaged;

a cooling unit configured to maintain the cabinet at a predetermined temperature;

a temperature sensor arranged within the cabinet, wherein the temperature sensor is configured to detect a temperature within the cabinet; and a control unit in communication with the cooling unit and the temperature sensor, wherein the control unit is configured to control the cooling unit so as to maintain a temperature within the cabinet at a predetermined temperature as determined by the temperature sensor, wherein the control unit is configured to lock the door until a temperature within the cabinet is at the predetermined temperature, wherein the predetermined temperature is below a freezing point of the beverage such that the beverage is stored as a supercooled liquid, wherein the control unit operates a first indicator in response to engaging the lock and a second indicator in response to disengaging the lock, wherein the first indicator comprises a first light, and wherein the second indicator comprises a second light.

2. The cooler of claim 1, wherein the door comprises a transparent portion such that the interior volume of the cabinet is visible from an exterior of the cooler.

3. The cooler of claim 1, wherein the door comprises a display screen.

4. The cooler of claim 1, wherein the predetermined temperature is in a range of about −1° C. to about −10° C.

5. The cooler of claim 1, wherein the control unit is configured to set a temperature of the cabinet at a first predetermined temperature or a second predetermined temperature, wherein the first predetermined temperature differs from the second predetermined temperature.

6. The cooler of claim 5, wherein the first predetermined temperature is 0.1° C. to 10° C.

7. The cooler of claim 6, wherein the second predetermined temperature is −1° C. to −10° C.

8. A method of operating a cooler, comprising:

receiving an input indicating a type of a beverage to be stored in the cooler, setting based on the input, a temperature inside of the cooler in which a container of the beverage is stored to a predetermined temperature that is below a freezing point of the beverage such that the beverage is supercooled;

locking a door of the cooler when a temperature inside of the cooler is above the predetermined temperature;

operating a first indicator in response to locking the door;

unlocking the door of the cooler when the temperature inside of the cooler is at or below the predetermined temperature; and operating a second indicator in response to unlocking the door.

9. The method of claim 8, wherein operating the first indicator comprises illuminating a first light, and operating the second indicator comprises illuminating a second light.

10. The method of claim 8, wherein setting the temperature comprises activating a cooling unit, and wherein the method further comprises deactivating the cooling unit when the temperature within the cooler is at or below the predetermined temperature.

11. The method of claim 10, further comprising operating the cooling unit based on a demand condition of the cooler, wherein the demand condition corresponds to a number of times the door of the cooler is opened in a predetermined period.

* * * * *